US007398043B2

(12) United States Patent
Ikeda et al.

(10) Patent No.: US 7,398,043 B2
(45) Date of Patent: Jul. 8, 2008

(54) IMAGE FORMING APPARATUS FREE OF DEFECT DUE TO SUBSTANCES BLEEDING FROM TRANSFERRING MEMBER

(75) Inventors: Yuichi Ikeda, Abiko (JP); Jun Tomine, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 11/234,234

(22) Filed: Sep. 26, 2005

(65) Prior Publication Data

US 2006/0067729 A1 Mar. 30, 2006

(30) Foreign Application Priority Data

Sep. 29, 2004 (JP) ..... 2004-285228

(51) Int. Cl.
*G03G 15/20* (2006.01)

(52) U.S. Cl. ..... 399/313; 399/101

(58) Field of Classification Search ..... 399/49, 399/66, 72, 101, 302, 308, 313, 314
See application file for complete search history.

(56) References Cited

U.S. PATENT DOCUMENTS

| | | | | |
|---|---|---|---|---|
| 5,862,447 | A * | 1/1999 | Matsumura | 399/388 |
| 6,061,533 | A | 5/2000 | Kajiwara | 399/49 |
| 6,173,135 | B1 * | 1/2001 | Yuminamochi et al. | 399/66 |
| 6,243,544 | B1 * | 6/2001 | Tsuneeda | 399/66 |
| 6,341,205 | B1 | 1/2002 | Yoshino et al. | 399/101 |
| 6,459,865 | B2 * | 10/2002 | Kusayanagi | 399/101 |
| 6,654,570 | B2 | 11/2003 | Kato | 399/66 |
| 6,823,152 | B2 * | 11/2004 | Kida | 399/101 |
| 6,898,393 | B2 * | 5/2005 | Kawamura | 399/100 |
| 6,941,085 | B2 * | 9/2005 | Nakano et al. | 399/66 |
| 2001/0014230 | A1 | 8/2001 | Kusayanagi | |
| 2005/0201775 | A1 | 9/2005 | Ikeda | 399/101 |
| 2005/0281570 | A1 | 12/2005 | Takeuchi et al. | 399/49 |

FOREIGN PATENT DOCUMENTS

CN 1223390 A 7/1999

(Continued)

OTHER PUBLICATIONS

Patent Abstracts of Japan, Publication No. 2002031967, Jan. 31, 2002.
Patent Abstracts of Japan, Publication No. 2003248361, Sep. 5, 2003.
English-language of an Office Action, i.e., Notification of First Office Action, dated Nov. 2, 2007, issued in Chinese counterpart Application No. 200510106962.6.
Office Action, dated Feb. 6, 2008, issued in European counterpart Application No.: 05 020 822.2-2225.

*Primary Examiner*—Robert Beatty
(74) *Attorney, Agent, or Firm*—Fitzpatrick, Cella, Harper & Scinto

(57) ABSTRACT

An image forming apparatus includes an image bearing member for carrying a toner image; a toner image developing device for forming a toner image on the image bearing member; a transfer roller for contacting the image bearing member to form a nip therebetween and for being supplied with a voltage to transfer the toner image from the image bearing member onto the recording material in the nip; a voltage source for applying a voltage to the transfer roller; an executing devise for executing a toner application mode for transferring the toner image onto the transfer roller by applying a voltage to the transfer roller contacted to the toner image in the nip. A size of the toner image transferred onto the transfer roller during an operation in the toner application mode is equal to or longer than one full circumferential length of the transfer roller with respect to a peripheral moving direction of the image bearing member and is equal to an image forming area of the image bearing member with respect to a direction perpendicular to the peripheral moving direction of the image bearing member.

7 Claims, 12 Drawing Sheets

FOREIGN PATENT DOCUMENTS

| | | | | |
|---|---|---|---|---|
| EP | 1 202 130 | A2 | | 5/2002 |
| EP | 1 607 805 | A1 | | 12/2005 |
| JP | 55157753 | A | * | 12/1980 |
| JP | 04253073 | A | * | 9/1992 |
| JP | 6-35279 | | | 2/1994 |
| JP | 7-20726 | | | 1/1995 |
| JP | 09062057 | A | * | 3/1997 |
| JP | 10031375 | A | * | 2/1998 |
| JP | 11-160926 | | | 6/1999 |
| JP | 2000010364 | A | * | 1/2000 |
| JP | 2000-147849 | | | 5/2000 |
| JP | 2002-31967 | | | 1/2002 |
| JP | 2002-99148 | | | 4/2002 |
| JP | 2002-202672 | | | 7/2002 |
| JP | 2004-117597 | | | 4/2004 |
| JP | 2004-126506 | | | 4/2004 |

* cited by examiner

IMAGE FORMING APPARATUS FREE OF DEFECT DUE TO SUBSTANCES BLEEDING FROM TRANSFERRING MEMBER

FIELD OF THE INVENTION AND RELATED ART

Each time substances having bled from a transferring member adhere to an image bearing member, an operation for removing such substances on the image bearing member is carried out. As for the method for removing such substances, an image is formed on the image bearing member, of toner, and such substances are removed along with the image formed of toner.

However, the above descried method for removing the unwanted substances from the image bearing member is problematic in that while the operation for removing the unwanted substances is carried out, the operation for forming an image on recording medium cannot be carried out, reducing thereby an image forming apparatus in productivity.

SUMMARY OF THE INVENTION

The primary object of the present invention is to prevent the reduction in productivity of an image forming apparatus, which is attributable to the abovementioned operation for removing the unwanted substances transferred onto the image bearing member.

Another object of the present invention is to provide an image forming apparatus comprising:

a rotational image bearing member;

toner image forming means for forming toner images on said image bearing member;

a transferring member for transferring an image on said image bearing member, onto recording medium by contacting said image bearing member, in the transfer area;

an electric power source for applying a first bias to said transferring member when said transferring member transfers the toner image onto the recording medium; and means for carrying out the mode in which the toner image on said image bearing member is transferred onto said transferring member by applying to said transferring member, a second bias which is the same in polarity as the first bias but different in other attributes from the first bias.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

According to the present invention, an image forming apparatus is provided with a means for carrying out a mode in which an electric power source applies a second bias, that is, a bias different from a first bias applied to transfer a toner image on the image bearing member onto a transferring member, to the transferring member to transfer the toner image on the image bearing member onto transferring member, and which is carried out when recording medium is not present in the transfer area.

The provision of the structural arrangement for this means made it possible to prevent substances from bleeding from a transferring member, making unnecessary the operation for removing the substances having adhered to the image bearing member. Thus, it solved the problem that an image forming apparatus was reduced in productivity.

Hereinafter, the preferred embodiments of the present invention will be described in detail. In the following descriptions of the embodiments, if a component in one of the drawings is identical in referential symbol to a component in another drawing, the two components are identical in structure or function, and therefore, only the former will be described to avoid the repetition of the same description.

Embodiment 1

Figure 1:
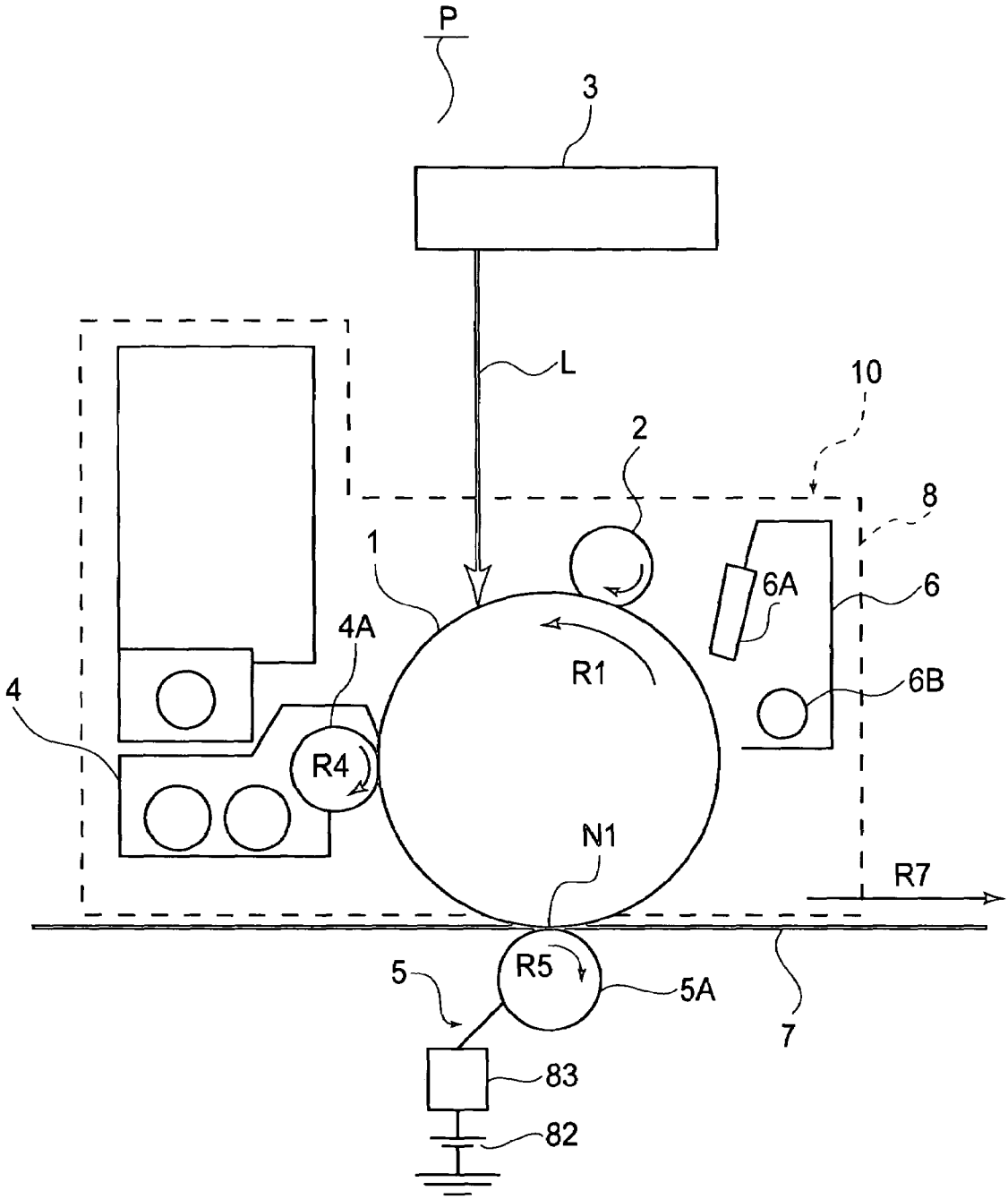
FIG. 1 is a schematic vertical sectional view of the photosensitive drum and its adjacencies in the first embodiment of the present invention, showing the general structures thereof.

Shown in FIG. 1 is the image forming portion P (toner image forming means) of an image forming apparatus to which the present invention is applicable. FIG. 1 is a schematic vertical sectional view of the image forming portion P, more specifically, a schematic vertical sectional view of the image forming portion P at a vertical plane parallel to the direction (indicated by arrow mark R7) in which the intermediary transfer belt 7 (image bearing member) as an intermediary transferring member (toner image bearing member) is moved.

In the image forming portion P shown in the drawing, an electrophotographic photosensitive member 1 in the form of a drum (which hereinafter will be referred to as "photosensitive drum") is disposed.

In this embodiment, the photosensitive drum 1 is rotationally driven by a driving means (unshown) in the direction indicated by an arrow mark R1 at a process speed (peripheral speed) of 100 mm/sec. In the adjacencies of the peripheral surface of the photosensitive drum 1, a charge roller 2 (charging means), an exposing apparatus 3 (electrostatic latent image forming means), a developing apparatus 4 (developing means), a primary transferring means 5, and a cleaning apparatus 6 are disposed roughly in the listed order.

As the photosensitive drum 1 is rotationally driven, the peripheral surface of the photosensitive drum 1 is charted by the charge roller 2, which is kept in contact with the peripheral surface of the photosensitive drum 1, and to which charge bias is applied by a charge bias application power source (unshown). As a result, the peripheral surface of the photosensitive drum 1 is uniformly charged to predetermined polarity and potential level.

Across the charged peripheral surface of the photosensitive drum 1, an electrostatic latent image is formed by the exposing apparatus 3. The exposing apparatus 3 projects a beam of laser light L according to image formation data, and the peripheral surface of the photosensitive drum 1 is exposed to this beam of laser light L. As a result, electrical charge is removed from numerous points of the charged peripheral surface of the photosensitive drum 1, effecting an electrostatic latent image.

The electrostatic latent image is developed by the developing apparatus 4, which has a development sleeve 4A rotatable in the direction indicated by an arrow mark R4 while bearing developer on its peripheral surface. To the development sleeve 4A, development bias is applied by a development bias application power source (unshown). The toner in the developer borne on the peripheral surface of the development sleeve 4A is adhered to the electrostatic latent image by this application of development bias, developing thereby the electrostatic latent image into an image formed of toner (which hereinafter will be referred to as toner image). Incidentally, the toner used in this embodiment is negative in the inherent polarity.

The toner image having formed through the above described process is transferred by a primary transferring means 5 onto the surface of the intermediary transfer belt 7 as an intermediary transferring member, that is, a transfer medium different from the final transfer medium. The primary transferring means 5 has: a primary transfer roller 5A (charging member of contact type) which is kept in contact with the photosensitive drum 1; a transfer bias applying means 82 for applying bias to the primary transfer roller 5A; and a controlling apparatus 83 (bias controlling means) for controlling the transfer bias applying means 82. The primary transfer roller 5A keeps the outward surface of the intermediary transfer belt 7 in contact with the peripheral surface of the photosensitive drum 1 by pressing the intermediary transfer belt 7 from the inward side of the loop, which the intermediary transfer belt 7 forms, forming thereby a primary transfer nip N1 between the peripheral surface of the photosensitive drum 1 and the intermediary transfer belt 7. As the intermediary transfer belt 7 is rotationally driven in the direction indicated by an arrow mark R7, the primary transfer roller 5A is rotated in the direction indicated by an arrow mark R5 by the movement of the intermediary transfer belt 7, and the abovementioned toner image having been formed on the peripheral surface of the photosensitive drum 1 is electrostatically transferred (primary transfer) onto the outward surface of the intermediary transfer belt 7 by the application of the primary transfer bias to the primary transfer roller 5A from the transfer bias application power source 82, in the primary transfer nip N1. Incidentally, the primary transfer bias in this embodiment is in the form of DC voltage (DC component), and its polarity is opposite to the normal polarity to which toner becomes charged. In other words, in the following embodiments of the present invention which will be described hereafter, the normal polarity to which toner becomes charged is negative, and therefore, the polarity of the abovementioned primary transfer bias is positive.

The toner (residual toner) remaining on the peripheral surface of the photosensitive drum 1 without being transferred onto the intermediary transfer belt 7 during the primary transfer process is removed by the cleaning blade 6A of the cleaning apparatus 6, and is recovered by a waste toner conveyance screw 6B into a waste toner bin (unshown) After being cleaned across its peripheral surface, the photosensitive drum 1 is used for the next image formation cycle which starts from the charging step.

In this embodiment, the above described photosensitive drum 1, charge roller 2, developing apparatus 4, and cleaning apparatus 6 are integrally disposed in a container 8 (unshown) in the form of a cartridge, making up a process cartridge 10. This cartridge 10 is rendered removably mountable in the main assembly (unshown) of an image forming apparatus. Thus, if the photosensitive drum 1, for example, reaches the end of its service life, the cartridge 10 can be removed in entirety from the main assembly of the image forming apparatus so that it is replaced with a brand-new one.

Figure 2:
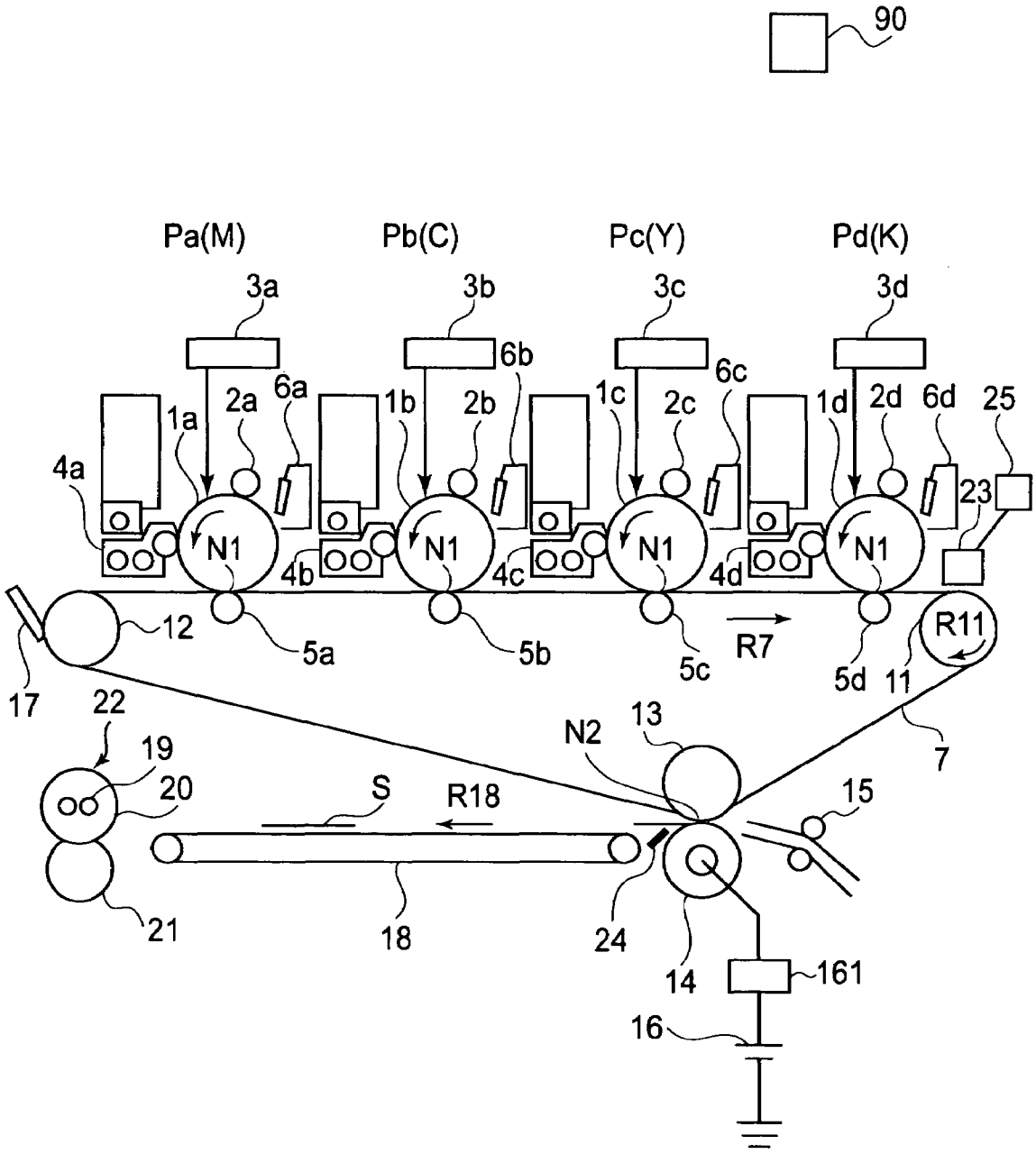
FIG. 2 is a schematic vertical sectional view of the image forming apparatus in the first embodiment of the present invention, showing the general structure thereof.

The image forming apparatus shown in FIG. 2 is provided with four image forming portions Pa, Pb, Pc, and Pd. These image forming portions Pa, Pb, Pc, and Pd form toner images of magenta (M), cyan (C), yellow (Y), and black (K) colors, respectively.

In these image forming portions Pa, Pb, Pc, and Pd, photosensitive drums 1*a*, 1*b*, 1*c*, and 1*d*, charge rollers 2*a*, 2*b*, 2*c*, and 2*d*, exposing apparatuses 3*a*, 3*b*, 3*c*, and 3*d*, developing apparatuses 4*a*, 4*b*, 4*c*, and 4*d*, primary transfer rollers 5*a*, 5*b*, 5*c*, and 5*d*, and cleaning apparatuses 6*a*, 6*b*, 6*c*, and 6*d*, are disposed, respectively, as are the photosensitive drum 1, charge roller 2, exposing apparatus 3, developing apparatus 4, primary charge roller 5, and cleaning apparatus 6 disposed in the image forming portion P shown in FIG. 1. In these image forming portions Pa, Pb, Pc, and Pd, magenta, cyan, yellow, and black toner images are formed on the photosensitive drums 1*a*, 1*b*, 1*c*, and 1*d*, respectively, as is a toner image formed in the above described image forming portion P. Incidentally, in FIG. 2, the components equivalent to the transfer bias application power source 82 and controlling apparatus 83 shown in FIG. 1 are not shown.

These four toner images different in color are sequentially transferred (primary transfer) onto the intermediary transfer belt 7 as an intermediary transfer medium. The intermediary transfer belt 7 is in the endless form, and is stretched around three rollers, that is, a drive roller 11, follower roller 12, and a subordinate secondary transfer roller 13 (subordinate to second transfer roller). As the drive roller 11 is rotated in the direction indicated by an arrow mark R11 (clockwise direction in FIG. 2), the intermediary transfer belt 7 is rotated by the rotation of the drive roller 11 in the direction indicated by an arrow mark R7. The intermediary transfer belt 7 is formed, in the endless form, of dielectric resin, for example, polyimide, polycarbonate, polyethylene terephthalate, polyfluorovinylidene, etc. A secondary transfer roller 14 is disposed in contact with the outward surface of the intermediary transfer belt 7 so that it opposes the subordinate secondary transfer roller 13. The interface between the second transfer roller 14 and intermediary transfer belt 7 constitutes a secondary transfer nip N2. The magenta, cyan, yellow, and black toner images formed on the photosensitive drums 1*a*, 1*b*, 1*c*, and 1*d* in the image forming portions Pa, Pb, Pc, and Pd, respectively, are transferred (primary transfer) in layers onto the intermediary transfer belt 7 by the application of the primary transfer bias to the primary transfer rollers 5*a*, 5*b*, 5*c*, and 5*d*, respectively, in the primary transfer nips N1.

After being layered on the intermediary transfer belt 7, the four toner images different in color are transferred onto a recording medium S by the secondary transfer roller 14, which is kept pressed against the above described subordinate secondary transfer roller 13, with the intermediary transfer belt 7 pinched between the two secondary transfer rollers 14 and 13. Thus, the secondary transfer nip N2 (transfer area) is formed between the secondary transfer roller 14 (transferring member) and intermediary transfer belt 7. The recording mediums S used for image formation are stored in a sheet feeder cassette (unshown), and are conveyed by a sheet feeding-conveying apparatus (unshown) having a feed roller, a conveyance roller, conveyance guide, etc. (all of which are also unshown), to a pair of registration rollers 15, by which they are corrected in attitude if they are askew. Then, each recording medium S is conveyed to the abovementioned secondary transfer nip N2. To the secondary transfer roller 14, secondary transfer bias is applied from a secondary transfer roller bias application power source 16 (electrical power source) while the recording medium S is moved through the secondary transfer nip N2. The polarity of the secondary transfer bias is positive, that is, opposite to the normal polarity (negative) to which toner becomes charged. The magnitude of the transfer bias applied to the secondary transfer roller 14 from the secondary transfer bias power source 16 is controlled by the controlling apparatus 161 (bias controlling means). By this transfer bias, the four toner images, different in color, on the intermediary transfer belt 7 are transferred (secondary transfer) all at once onto the recording medium S in the secondary transfer nip N2. The toner (residual toner) remaining on the intermediary transfer belt 7, that is, the toner which failed to be transferred, during the secondary transfer, is removed by a belt cleaner 17 disposed in a manner to oppose the follower roller 12.

After the transfer (secondary transfer) of the toner images onto the recording medium S, the recording medium S is cleared of electrical charge by a charge removal needle 24, and is conveyed to a fixing apparatus 22 by a conveyer belt 18, which rotates in the direction indicated by an arrow mark R18. The fixing apparatus 22 has a fixation roller 20 in which a heater 19 is disposed, and a pressure roller 21 which is kept pressed upon the fixation roller 20 so that a fixation nip is formed between the fixation roller 20 and pressure roller 21. While the recording medium S is conveyed through the fixation nip, the toner images are subjected to the heat and pressure applied by the fixation roller 20 and pressure roller 21. As a result, the toner images are fixed to the surface of the recording medium S. After the fixation of the toner images, the recording medium S is discharged from the main assembly (unshown) of the image forming apparatus, ending the formation of a full-color images, composed of four toner images different in color, on the recording medium S, or a single sheet of recording medium.

In this embodiment, the image forming apparatus main assembly is provided with a density sensor 23 (density detecting means), which is disposed so that it directly faces the outward surface of the portion of the abovementioned intermediary transfer belt 7, which is moving past the driver roller 11. The density sensor 23 is a sensor of the reflection type, and is made up of a light emitting element (LED) and a light receiving element. On the intermediary transfer belt 7, referential toner images (which hereinafter may be referred to as patches) which provide referential density levels for primary colors, are formed in the image forming portions Pa, Pb, Pc, and Pd. The density sensor 23 detects the amount of light reflected by these patches. The detection results are sent to a controlling means 25. The controlling means 25 computes the amount of the toner on the intermediary transfer belt 7 based on the amount of the light detected by the density sensor 23, and controls the image formation conditions (potential level to which photosensitive drum is to be charged, T/C ratio, etc.) based on the results of the computation.

Also in this embodiment, the photosensitive drum 1*a*, charge roller 2*a*, developing apparatus 4*a*, and cleaning apparatus 6*a* are integrally disposed in a container in the form of a cartridge (unshown), as are the photosensitive drum 1, charge roller 2, developing apparatus 4, and cleaning apparatus 6 disposed in a cartridge 10 shown in FIG. 1, making up the process cartridge for magenta color, which is removably mountable in the main assembly of the image forming apparatus. The structures of the process cartridges for cyan, yellow, and black colors are the same as that of the process cartridge for the magenta color.

In this embodiment, the formation of defective images attributable to the bleeding of external additives or the like is reduced by uniformly adhering toner on the peripheral surface of the secondary transfer roller 14. Next, this subject will be described in detail.

In this embodiment, the secondary transfer roller 14 is made up of a core portion, and a roller proper which is formed of a single layer of ion-conductive foamed sponge, more specifically, foamed sponge formed of ion-conductive NBR (nitrile rubber)+hydrin rubber. It is 320 mm in length, 24 mm in external diameter, 34° in hardness (Asker C scale), $1\times10^8$ ohm in electrical resistance, and 5.0 k in the contact pressure against the intermediary transfer belt 7. It should be noted here that the contact pressure means the contact pressure between the secondary transfer roller 14 and intermediary transfer belt 7, with the intermediary transfer belt 7 remaining pinched between the secondary transfer roller 14 and subordinate secondary transfer roller 13.

If the secondary transfer roller 14 is left pressed upon the intermediary transfer belt 7 for a long time, the additives in the NBR and hydrin which make up the actual roller portion of the secondary transfer roller 14 bleed, and adhere to the intermediary transfer belt 7. The adhesion of these additives to the intermediary transfer belt 7 reduces, in the secondary transfer efficiency, the portion of the intermediary transfer belt 7 to which the additives have adhered. Thus, if an image forming apparatus, the intermediary transfer belt 7 of which is bearing the additives having bled from the secondary transfer roller 14, is used to form a halftone image, a defective halftone image, that is, a halftone image having unwanted bare spots, which correspond in position to the portion of the intermediary transfer belt 7 contaminated by the additives from the secondary transfer roller 14, is formed; a halftone image with unwanted bare spots is formed.

This formation of an image with unwanted bare spots is likely to occur when the secondary transfer roller 14 in an image forming apparatus is fairly new. It has been discovered, however, that uniformly coating the surface (peripheral surface) of the secondary transfer roller 14 with toner improves the image forming apparatus in terms of the severity of the abovementioned image defect in a halftone image (halftone portions), or the presence of unwanted bare spots.

Figure 3:
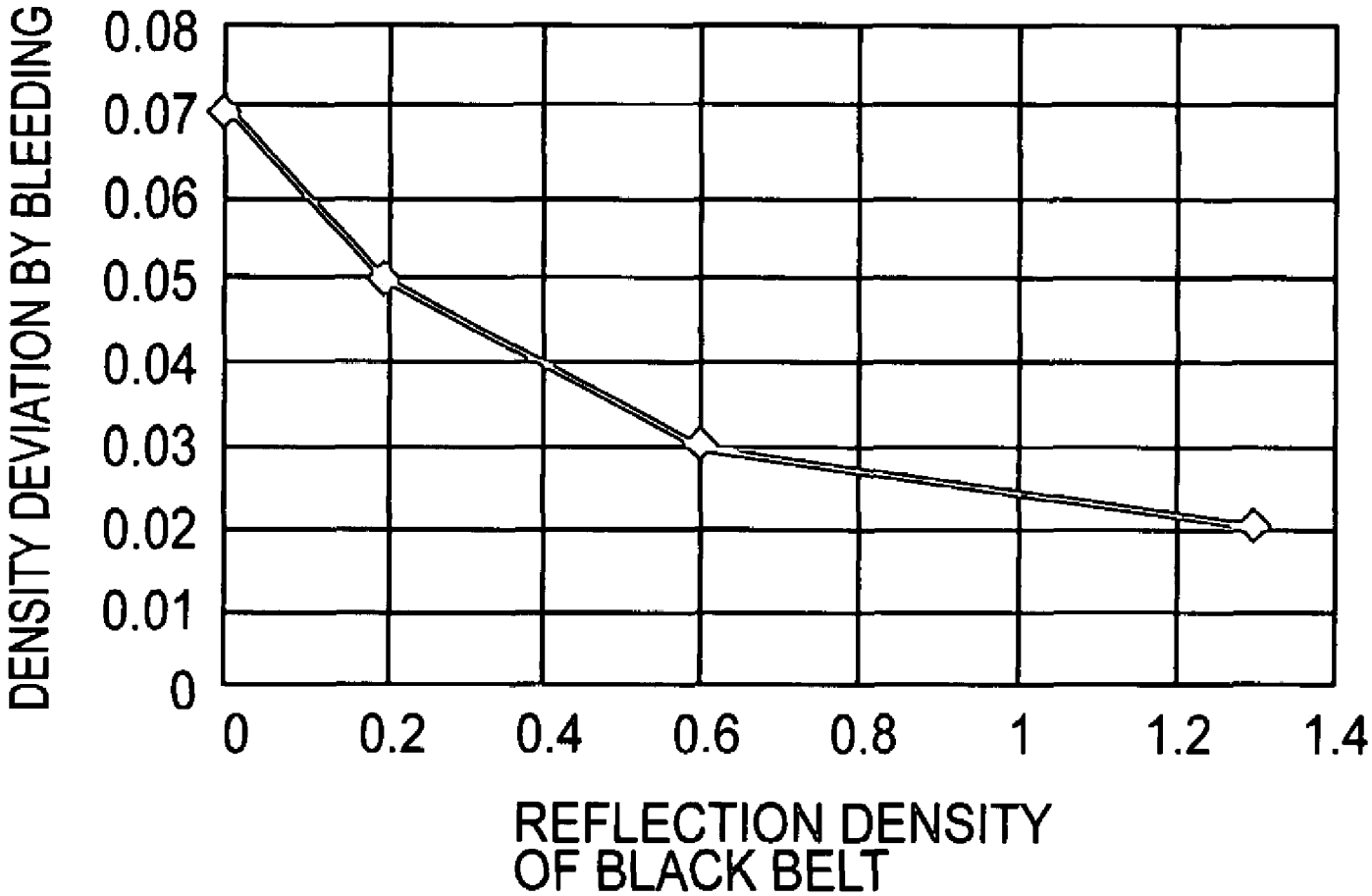
FIG. 3 is a graph depicting the relationship between the density of the black belt and the amount of the density deviation (anomaly) attributable to the substances having adhered to the image bearing member after bleeding from the transferring member.

FIG. 3 shows the relationship between the density of the toner image (black belt) formed (placed) on the peripheral surface of the secondary transfer roller 14 and the amount of the density deviation (anomaly) attributable to the bleeding of the additives. In FIG. 3, the horizontal axis represents the reflection density of the black belt, and vertical axis represents the amount of density deviation attributable to the bleeding of the additives.

Figure 15:
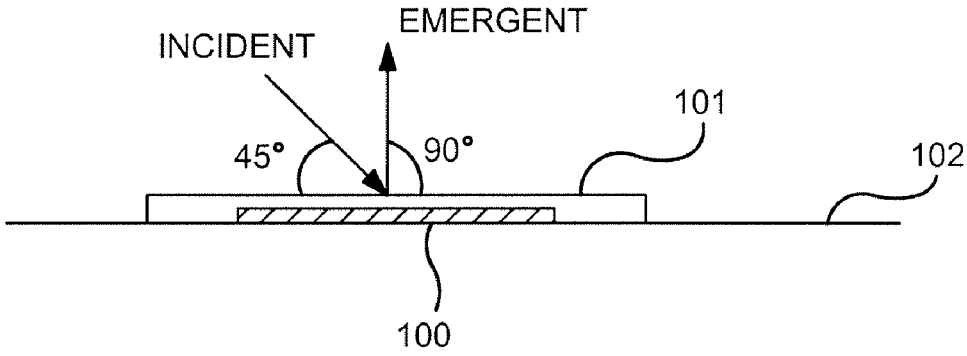
FIG. 15 is a drawing describing the method for measuring the reflection density of the black belt on the image bearing member.

The refection density of the black belt is measured as follows:

A black belt 100 formed (placed) on the intermediary transfer belt 7 is picked up by a piece of transparent tape 101 formed of Mylar film. Then, the tape 101 to which the black belt 100 has been adhered is pasted to a paper 102. Then, the refection density (A) of the portion of the paper 102 having the black belt 100 is measured with a reflection density meter (incidence angle: 45°; reflection angle: 90°; FIG. 15). Then, another piece of tape 101, by which the black belt has not been picked up, is pasted to the paper 102, and the reflection density (B) of the portion of the paper 100, having no black belt 100, is measured. Then, the value of (A−B) is obtained, and is used as the reflection density of the black belt 100.

FIG. 3 shows the difference in density between the bare spots (portions) and other portions of a halftone image which was 0.6 in reflection density, and which was formed after the secondary transfer roller 14 was kept pressed upon the intermediary transfer belt 7 for 10 days in an environment in which the temperature and humidity were 30° C. and 80%, respectively. As will be evident from FIG. 3, it was discovered that changing the density of the toner image (image pattern) to be coated on the secondary transfer roller 14 affects the difference in density between the bare portions and rest of a halftone image (which herein after may be referred to simply as density deviation). In other words, it is evident from the same drawing that as long as the reflection density of the black belt is no less than 0.6, the density difference attributable to the bleeding is no more than 0.03. Generally, if the density deviation attributable to the bleeding is no more than 0.03, it is difficult to detect the anomaly; it is inconspicuous.

In this embodiment, a toner image in the form of a wide black belt, which is no less than 0.6 in reflection density is formed on the peripheral surface of the photosensitive drum 1*d* (FIG. 2), and this black belt is transferred onto the intermediary transfer belt 7. Then, the black belt on the intermediary transfer belt 7 is transferred onto the secondary transfer roller 14, coating thereby the peripheral surface of the secondary transfer roller 14. In other words, the image forming apparatus is enabled to operate in a mode in which the second transfer roller 14 is coated with toner; it is given a second transfer roller coating mode (which hereinafter will be referred to simply as coating mode). This coating mode is carried out with a predetermined timing by a secondary transfer roller coating means 90. When the coating mode is carried out, no recording medium S is present in the secondary transfer nip N2. Incidentally, in this embodiment, the coating mode is carried out when an image forming apparatus is shipped out, and when the secondary transfer roller 14 is replaced.

Figure 4:
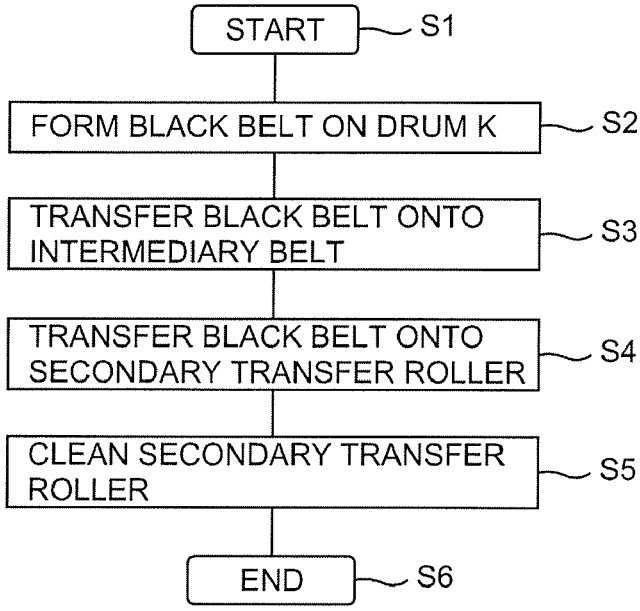
FIG. 4 is a flowchart showing the operational flow of the image forming apparatus, in the first embodiment, in the mode in which the secondary transfer roller is coated with toner.

FIG. 4 is a flowchart showing the flow of the operational sequence in the secondary transfer roller coating mode. As the image forming apparatus begins to be operated in the secondary transfer roller coating mode (S1), a black belt (toner image for coating) is formed on the photosensitive drum 1*d* in the image forming portion Pd, that is, the image forming portion for forming black images (K) (S2). This black belt is formed on the photosensitive drum 1*d* through the charging process carried out by the charge roller 2*d*, exposing process carried out by the exposing apparatus 3*d*, and developing process carried out by the developing apparatus 4*d*. As for the size of the black belt, the black belt is formed so that in terms of the direction parallel to the axial line of the photosensitive drum 1*d*, its dimension matches the entirety of image formation range, and in terms of the circumferential direction of the photosensitive drum 1*d*, its dimension matches, or is greater than, the circumference of the secondary transfer roller 14. In other words, the black belt is given such a size that no matter where on the surface of the intermediary transfer belt 7 the tone image (black belt) will be transferred, and no matter which portion of the peripheral surface of the secondary transfer roller, in terms of the circumferential direction of the roller 14, will be kept in contact the intermediary transfer belt 7 (no matter where on the peripheral surface of the secondary transfer roller 14, in terms of the circumferential direction of the roller 14, the additives will adhere), the portion of the peripheral surface of the secondary transfer roller 14, to which the additives will have adhered, will be covered with the black belt (toner).

The black belt formed on the photosensitive drum 1*d* is electrostatically transferred (S3 in FIG. 4) onto the intermediary transfer belt 7 by the primary transfer roller 5*d* (FIG. 2). Referring to the top half of FIG. 6, the bias applied to the primary transfer roller 5*d* during this transfer is positive in polarity like the primary transfer bias applied during a normal image forming operation. Next, referring to the bottom half of FIG. 6, the black belt on the intermediary transfer belt 7 is electrostatically transferred onto the secondary transfer roller 14 (S4 in FIG. 4).

The DC component of the secondary transfer bias 14 applied to the secondary transfer roller 14 during a normal image forming operation is +2 Kv, whereas the bias applied to the secondary transfer roller 14 to transfer the black belt onto the secondary transfer roller 14 is +1.4 Kv. In other words, the absolute value of the DC component of the bias applied to the secondary transfer roller 14 when the secondary transfer roller coating mode is carried out is smaller than the absolute value of the bias applied to the transfer roller 5 during a normal image formation.

As for the reason therefor, when transferring the black belt onto the transfer roller 45, there is no recording medium S in the transfer nip N between the photosensitive drum 41 and transfer roller 45, unlike in a normal image formation. Therefore, the black belt can be satisfactorily transferred with the application of a bias, the absolute value of which is smaller than the bias applied for the normal image transfer operation. The normal transfer bias is set so that a proper amount of transfer current flows with the presence of the recording medium S in the transfer nip N, and therefore, when the recording medium S is not present in the transfer nip N as it is not in the coating mode, it is prudent to reduce the transfer bias in absolute value.

After the transfer of the black belt onto the secondary transfer roller 14, the excess toner on the secondary transfer roller 14 is removed (cleaning step: S5 in FIG. 4, and bottom half of FIG. 6). More specifically, first, bias (negative) opposite in polarity to the normal transfer bias is applied to the secondary transfer roller 14 for a length of time equivalent to one full rotation of the secondary transfer roller 14. This bias is a DC voltage with a potential level of −0.7 Kv. Then, a bias (positive) which is the same in polarity as the normal transfer bias is applied to the secondary transfer roller 14 for a length of time equivalent to one full rotation of the secondary transfer roller 14. This bias is a DC voltage and is +2 kv in potential level. In other words, the excessive amount of toner having adhered to the secondary transfer roller 14 is removed from the secondary transfer roller 14 by applying the bias the same in polarity to the normal transfer bias to the secondary transfer roller 14, after the application of the bias opposite in polarity to the normal transfer bias to the secondary transfer roller 14. The excessive amount of toner on the secondary transfer roller 14 is removed as described above, in order to prevent the so-call backside contamination, that is, the problem that the backside of the recording medium S is contaminated by the excessive amount of toner on the secondary transfer roller 14 during the secondary transfer in the following image forming operation. This ends the secondary transfer roller coating mode (S6).

Figure 5:
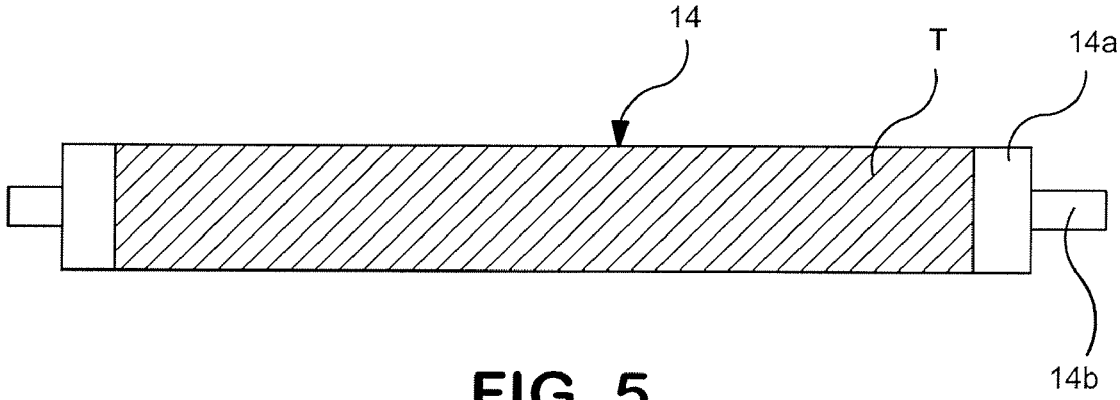
FIG. 5 is a front view of the secondary transfer roller in the first embodiment of the present invention.

Referring to FIG. 5, after the coating mode, the entirety of the peripheral surface of the secondary transfer roller 14 remains uniformly coated with the black belt (toner from black belt).

As will be evident from the above description of this embodiment, as the image forming apparatus is operated in the mode in which toner is uniformly adhered to the secondary transfer roller 14, the nonuniformity of the peripheral surface of the secondary transfer roller 14 in terms of the transfer efficiency, which is traceable to the adhesion of the additives having bled from the intermediary transfer medium, to the secondary transfer roller 14, is reduced in severity. Therefore, the occurrence of the image defect traceable to the bleeding of the additives is reduced. This method of reducing the occurrences of the abovementioned image defect is different from any of the methods in accordance with the prior art in that this method does not use toner to remove the additives having bled, that is, it does not waste toner, and also, that it is shorter in the length of the time required to start up an image forming apparatus.

Incidentally, in the above, this embodiment was described with reference to the case in which only DC voltage was applied as the primary and secondary transfer biases. However, this embodiment is not intended to limit the scope of the present invention. For example, a so-called compound bias, that is, the combination of a DC component and an AC component, may be applied as the primary and secondary transfer biases.

Embodiment 2

In the first embodiment described above, the present invention was applied to a full-color image forming apparatus which used four toners different in color. In this embodiment, the present invention is applied to a monochromatic image forming apparatus. In this embodiment, the photosensitive drum is the toner image bearing member.

Figure 7:
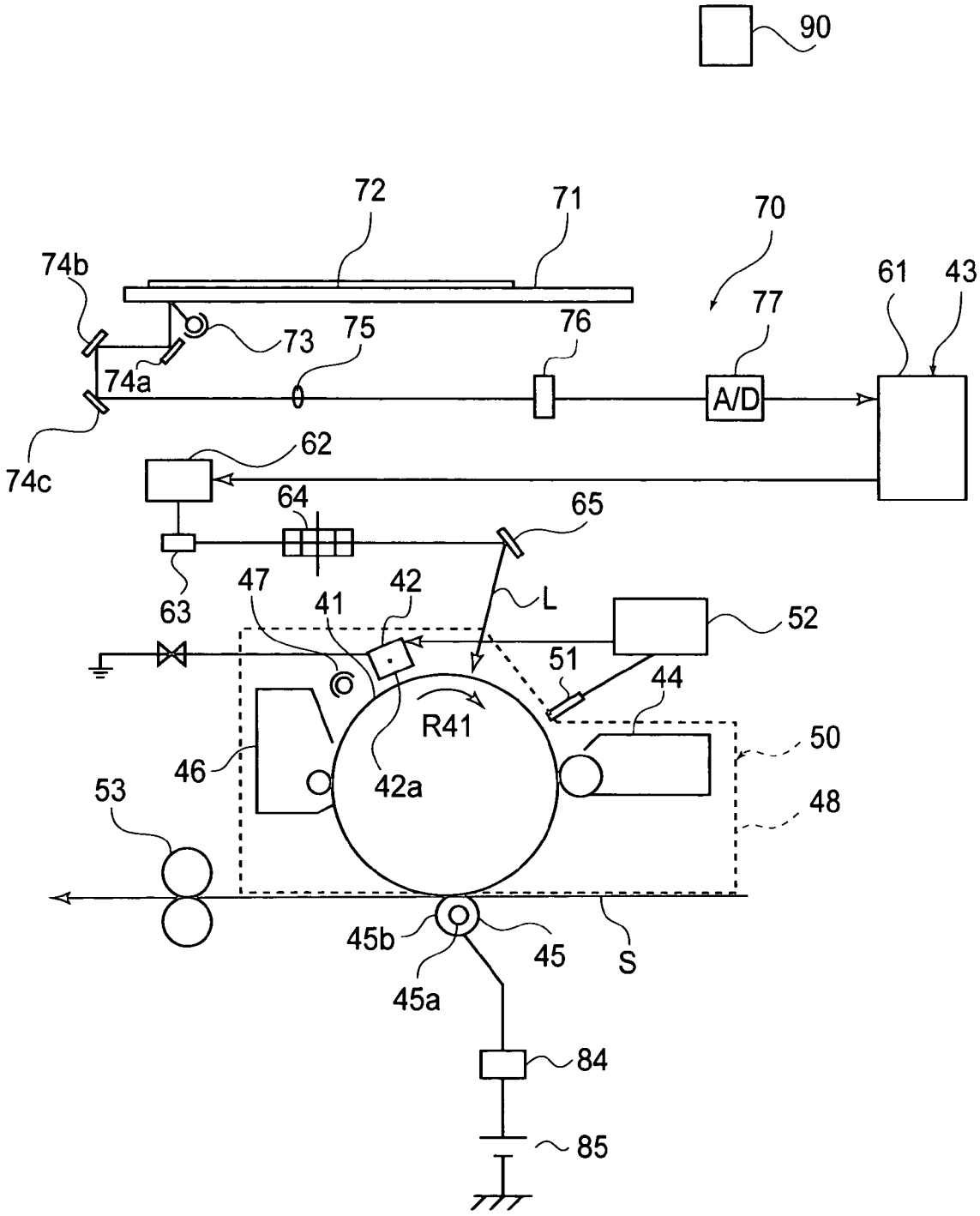
FIG. 7 is a schematic vertical sectional view of the image forming apparatus in the second embodiment of the present invention, showing the general structure thereof.

FIG. 7 is a drawing which schematically shows the general structure of the image forming apparatus in this embodiment. The photosensitive drum 41 (image bearing member) is made up of a cylindrical and electrically conductive substrate, and a layer of photoconductive substance coated on the peripheral surface of the substrate. The photosensitive drum 41 is rotatably supported by its axle so that it can be rotated in the direction indicated by an arrow mark R41 in the drawing. Disposed in the adjacencies of the peripheral surface of the photosensitive drum 41 in a manner of surrounding the photosensitive drum 41 are: a primary charging device 42 of the Scrotron type for charging the peripheral surface of the photosensitive drum 41; an exposing apparatus 43 for forming an electrostatic latent image on the charged photosensitive drum 41 by exposing the charged photosensitive drum 41 in response to video signals; a developing apparatus 44 for forming a toner image by adhering toner to the electrostatic latent image; a surface potential level sensor 51 disposed in the adjacencies of the developing portion to detect the potential level of the peripheral surface of the photosensitive drum 41; a transfer roller 45 (transferring member) for transfer the toner image formed on the photosensitive drum 41, onto a recording medium S; a transfer bias application power source 85 (electric power source) for applying bias to the transfer roller 45; a controlling apparatus 84 for controlling the bias to be applied from the transfer bias application power source 85 to the transfer roller 45; a cleaning apparatus 46 for removing the toner (residual toner) remaining on the photosensitive drum 41 after the toner image transfer; a pre-exposure lamp 47 for removing the residual electrical charge of the photosensitive drum 41; etc., listing in the order in which they are disposed in terms of the rotational direction of the photosensitive drum 41. Among these components, the photosensitive drum 41, primary charging device 42, developing apparatus 44, and cleaning apparatus 46 are integrally disposed in a container 48 in the form of a cartridge (outlined with a dotted line in drawing), making up a process cartridge 50, which is structured to be removably mountable in the main assembly (unshown) of the image forming apparatus so that as the photosensitive drum 41, for example, reaches the end of its service life, the cartridge 50 can be removed in entirety from the main assembly of the image forming apparatus to be replaced with a brand-new one.

After the transfer of a toner image onto the recording medium S, the recording medium S is separated from the photosensitive drum 41, and is conveyed to a fixing apparatus 53, in which the toner image on the recording medium S is fixed to the recording medium S; in other words, a desired print is completed. Then, the completed print is discharged from the main assembly of the image forming apparatus. In this embodiment, the abovementioned developing apparatus 44 employs the jumping developing method which uses a developer of the single component type.

The image forming apparatus in this embodiment forms images based on the image of an original 72 read by an image scanner 70. The image scanner 70 has: an original placement glass platen 71 on which the original 72 is placed; an illumination lamp 73; mirrors 74*a*, 74*b*, and 74*c*; a lens 75; a CCD 76, and an A/D converter 77. The image scanner 70 reads the original 72 on the original placement glass platen 71 by scanning the original 72 with the illumination lamp 73, and converts the image formation data which it obtains by the scanning, into electrical signals with its CCD 76. More specifically, as the original 72 is scanned by the illumination lamp 73, the light from the lamp 73 is reflected by the original 72, and the reflected light is guided by the mirrors 73*a*, 73*b*, and 73*c* to the lens 75, by which it is focused on the CCD 76. The electrical signals from the CCD 76 are converted into digital signals by the A/D converter 77, and then, are converted into video signals which correspond to 256 levels of gradation, ranging from 0 (00hex) to 255 (FFhex), which are proportional to image density levels. The video signals are sent to a laser driver 62 as a signal generating portion, and a beam of laser light is projected from a laser oscillator 63 while being modulated with the video signals. The beam of laser light projected while being modulated with the video signals which reflect the image formation data exposes the charged peripheral surface of the photosensitive drum 41, by way of a polygon mirror 64 and a mirror 52, writing thereby an electrostatic latent image on the peripheral surface of the photosensitive drum 41.

In this embodiment, the image formation steps up to the step in which the toner image is completed on the photosensitive drum 41 are the same as those in the first embodiment described above. That is, the photosensitive drum 41 is uniformly charged to the negative polarity by the primary charging device 42. The charge photosensitive drum 41 is exposed by the exposing apparatus 43, effecting an electrostatic latent image on the photosensitive drum 41. The electrostatic latent image on the charged photosensitive drum 41 is developed by the developing apparatus 44, which uses negatively charged toner, into an image formed of toner. The transfer roller 45 is kept in contact with the photosensitive drum 41, forming a transfer nip N. As a bias which is positive in polarity is applied to the transfer roller 45 from a transfer bias application power source 85 (electric power source) while the recording medium S is present in the transfer nip N, the toner image on the photosensitive drum 41 is transferred onto the recording medium S. The bias applied to the transfer roller 45 to transfer the toner image is +1 Kv, and the bias applied from the transfer bias application power source 85 to the transfer roller 45 is controlled by the controlling apparatus 84 (bias controlling means).

Because of the nonuniformity among manufacturing processes, the photosensitive drums 41 vary in chargeability; some are superior in chargeability to the other. Moreover, how satisfactorily the photosensitive drum 41 is charged is affected by the changes in the electrical discharge from the primary charging device 42 and changes in the chargeability of the photosensitive drum 41, which are affected by the length of time the photosensitive drum 41 has been in use and the ambience in which an image forming apparatus is used.

As for the technologies for compensating for the above described nonuniformity, the following technology has been known: A sensor 51 for detecting the potential level of the peripheral surface of the photosensitive drum 41 is disposed within the main assembly of the image forming apparatus, and the voltage applied to the grid 42*a* of the primary charging device 42 is varied so that the potential level of the peripheral surface of the photosensitive drum 41 remains constant at a predetermined level.

The surface potential level sensor 51 is made up of a light emitting element (LED, for example), and a light receiving element (unshown as is light emitting element). On the photosensitive drum 41, a toner image (patch), the density level of which is used as the density level reference, is formed, and the amount of the light reflected by the patch is read by the surface potential level sensor 51. Then, the amount of the toner on the photosensitive drum 41 is computed based on the read amount of the light reflected by the patch on the photosensitive drum 41, and the image formation conditions (potential level to which photosensitive drum is to be charged, laser power, etc.) are controlled based on the results of the computation.

The abovementioned transfer roller 45 is made up of a metallic core 45*a*, and an elastic member 45*b*, in the form of a roller, fitted around the peripheral surface of the metallic core 45*a*. The elastic member 45*b* is formed of rubber which contains ion-conductive substance such as sodium perchlorate, macromolecule elastomer such a urethane, foamed high polymer, etc. The electrical resistance of the transfer roller 45 is $1\times10^8$ ohm. The transfer bias applied to the transfer roller 45 is controlled so that the amount of the current flowed by the bias remains constant.

In this embodiment, the mode in which the peripheral surface of the transfer roller 45 is coated with toner is carried out when an image forming apparatus is shipped out, and when the transfer roller 45 is replaced. The coating mode is carried out by a transfer roller coating means 90.

Figure 8:
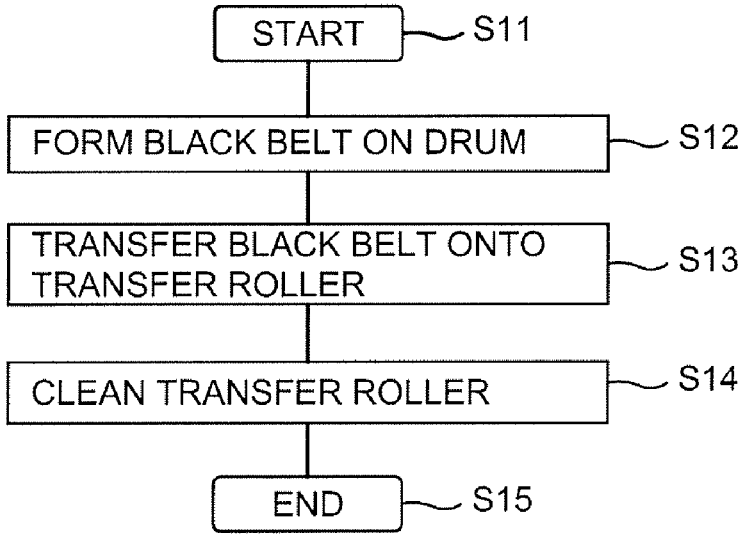
FIG. 8 is a flowchart showing the operational flow of the image forming apparatus, in the second embodiment, in the mode in which the transfer roller is coated with toner.

FIG. 8 is a flowchart showing the flow of the operational sequence carried out when the image forming apparatus is in the transfer roller coating mode. As the image forming apparatus begins to be operated in the coating mode (S11), a black belt is formed on the photosensitive drum 41 shown in FIG. 7. This black belt is formed on the photosensitive drum 41 through the charging process carried out by the primary charge roller 42, exposing process carried out by the exposing apparatus 43, and developing process carried out by the developing apparatus 44. As for the size of the black belt, the black belt is formed so that in terms of the direction parallel to the axial line of the photosensitive drum 41, its dimension matches the entirety of image formation range of the photosensitive drum 41, and in terms of the circumferential direction of the photosensitive drum 41, its dimension matches, or is greater than, the circumference of the transfer roller 41.

Figure 9:
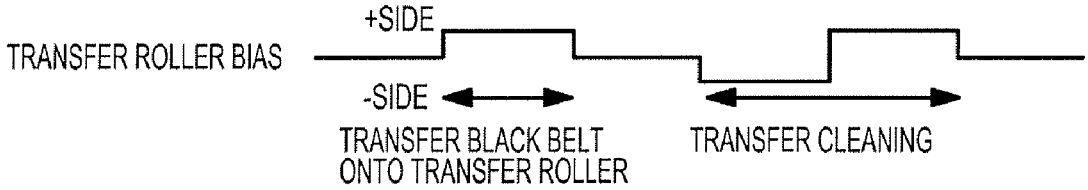
FIG. 9 is a timing chart describing the timing with which biases are applied to the transfer roller, in the mode in which the transfer roller is coated with toner, in the second embodiment.

The black belt formed on the photosensitive drum 41 is electrostatically transferred (S13 in FIG. 8) onto the transfer roller 45. Referring to FIG. 9, the bias applied to the transfer roller 45 during this transfer is positive in polarity like the primary transfer bias applied during a normal image forming operation. Further, it is the same in polarity (positive) as the DC component of the transfer bias applied during a normal image forming operation, and is smaller in absolute value. The DC component of the transfer bias applied to the transfer roller 45 during a normal image forming operation is +2 Kv, and the DC component of the bias applied to the transfer roller 45 to transfer the black belt onto the transfer roller 45 is +1.4 Kv. In other words, the absolute value of the DC component of the bias applied to the transfer roller 45 when the transfer roller coating mode is carried out is smaller than the absolute value of the bias applied to the transfer roller 45 during a normal image formation, for the following reason: When transferring the black belt onto the transfer roller 45, there is no recording medium S in the transfer nip N between the photosensitive drum 41 and transfer roller 45, unlike in a normal image formation. Therefore, the black belt can be satisfactorily transferred with the application of a bias, the absolute value of which is smaller than that of the bias applied for a normal image transfer operation. That is, the normal transfer bias is set so that a proper amount of transfer current flows with the presence of the recording medium S in the transfer nip N, and therefore, when the recording medium S is not present in the transfer nip N as it is not in this transfer roller coating mode, it is prudent to reduce the transfer bias in absolute value.

Figure 6:
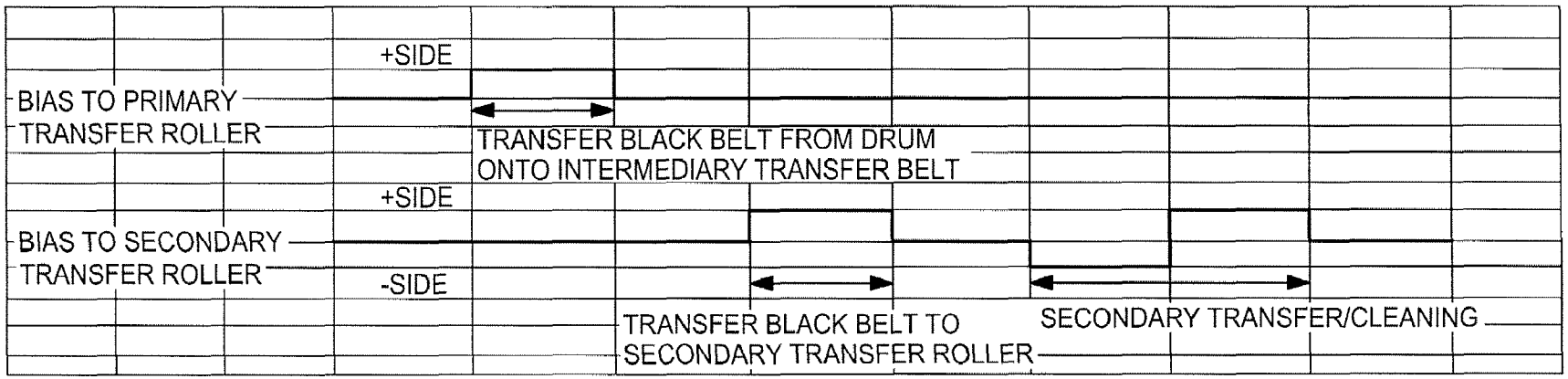
FIG. 6 is a timing chart describing the timing with which biases are applied to the primary and secondary transfer rollers, in the mode in which the secondary transfer roller is coated with toner, in the first embodiment.
Figure 14:
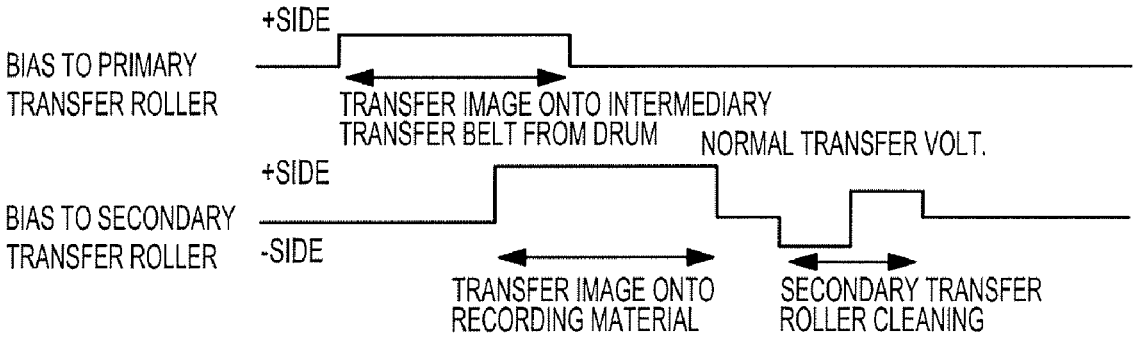
FIG. 14 is a graphical drawing showing the cleaning sequence in a normal image forming operation.

After the transfer of the black belt onto the transfer roller 45, a cleaning process in which the excess toner on the transfer roller 45 is removed is carried out (S14 in FIG. 14, and FIG. 6). More specifically, first, bias (negative) opposite in polarity to the normal transfer bias is applied to transfer roller 45 for a length of time equivalent to one full rotation of the transfer roller 45. This bias is −0.7 Kv in potential level. Then, a bias (positive) which is the same in polarity as the normal transfer bias is applied to the transfer roller 45 for a length of time equivalent to one full rotation of the transfer roller 45. In other words, the excessive amount of toner having adhered to the transfer roller 45 is removed from the transfer roller 45 by applying the bias the same in polarity to the normal transfer bias to the transfer roller 45 immediately after the application of the bias opposite in polarity to the normal transfer bias to the transfer roller 45. By removing the excessive amount of toner on the peripheral surface of the transfer roller 45 as described above, it is possible to prevent the occurrence of the so-call backside contamination, that is, the problem that the backside of the recording medium S is contaminated by the excessive amount of toner on the transfer roller 45 during the secondary transfer in the following image forming operation. This ends the transfer roller coating mode (S15 in FIG. 8).

After the transfer roller coating mode is carried out, the entirety of the peripheral surface of the transfer roller 45 remains covered with the black belt, that is, uniformly coated with toner.

As will be evident from the above description of this embodiment, as the image forming apparatus is operated in the mode in which toner is uniformly adhered to the transfer roller 45, the nonuniformity of the peripheral surface of the transfer roller 45 in terms of the transfer efficiency, which is traceable to the adhesion of the additives having bled from the transfer medium, to the transfer roller 45, is reduced in severity. As a result, the occurrence of the image defect traceable to the bleeding of the additives is reduced. This method of reducing the occurrences of the abovementioned image defect is different from any of the methods in accordance with the prior art in that this method does not use toner to remove the additives having bled, that is, it does not waste toner, and also, that it is shorter in the length of the time required to start up an image forming apparatus.

Incidentally, in the preceding first and second embodiments described above, the present invention was described with reference to the case in which only DC voltage was applied as the primary transfer bias, secondary transfer bias, and black belt transfer bias. However, these embodiments are not intended to limit the scope of the present invention. For example, the so-called compound voltage, that is, the combination of a DC voltage and an AC voltage, may be applied instead of DC voltage alone.

Embodiment 3

In this embodiment, a secondary transfer roller cleaning process different in sequence from the one in the first embodiment is employed.

Next, this embodiment will be described in detail. Incidentally, the image forming portion and image forming apparatus in this embodiment are the same as those in the above described preceding embodiments. That is, they are the same as those shown in FIGS. 1 and 2.

Figure 10:
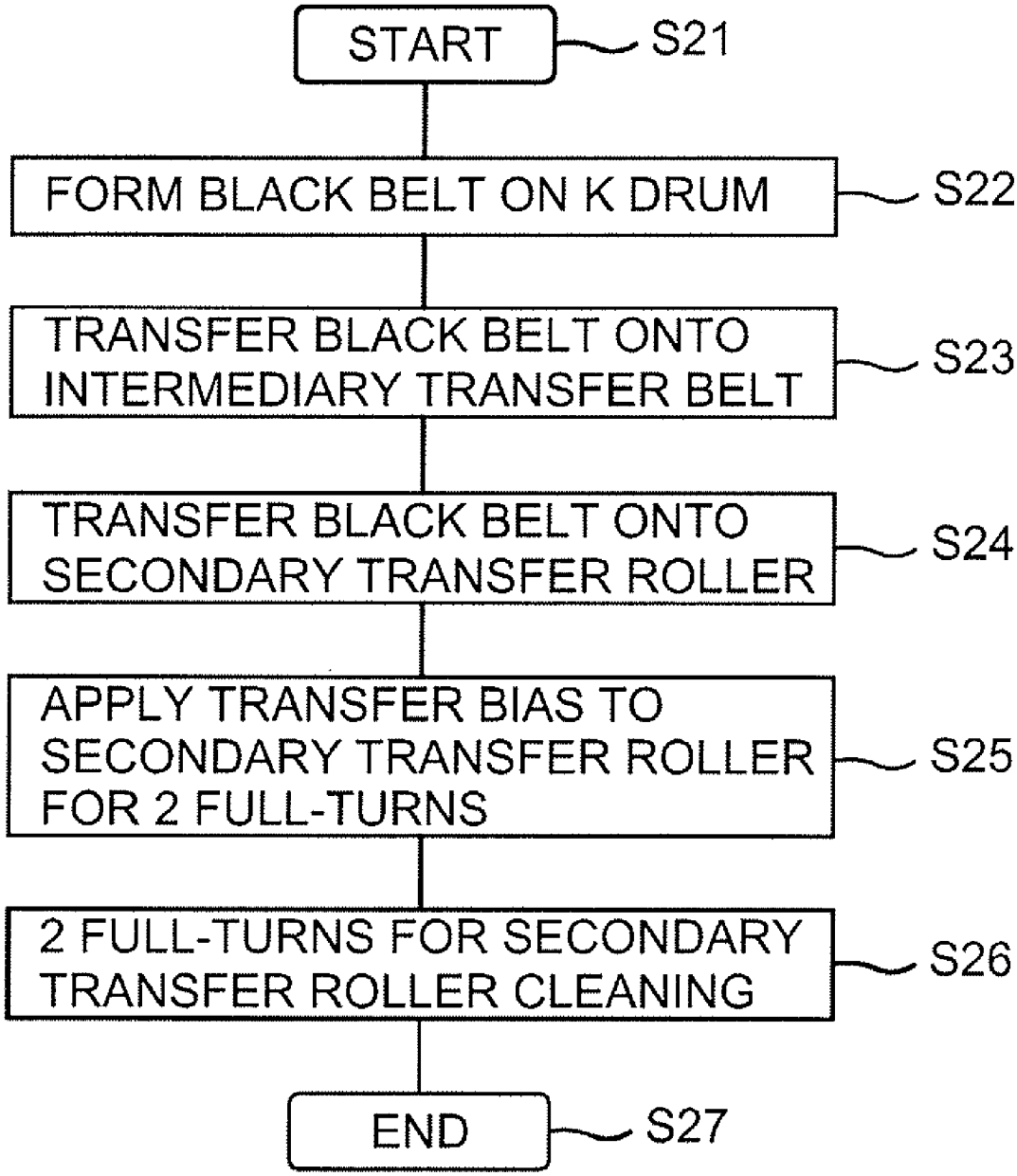
FIG. 10 is a flowchart showing the operational flow of the image forming apparatus, in the third embodiment, in the mode in which the secondary transfer roller is coated with toner.

FIG. 10 is a flowchart showing the flow of the operation of the image forming apparatus in the mode in which the secondary transfer roller is coated with toner. As the image forming apparatus begins to be operated in the mode in which the second transfer roller is coated with toner (S21), a black belt is formed on the photosensitive drum 1*d* in the image forming portion Pd, that is, the image forming portion for forming black images (K) (S22). This black belt is formed on the photosensitive drum 1*d* through the charging process carried out by the charge roller 2*d*, exposing process carried out by the exposing apparatus 3*d*, and developing process carried out by the developing apparatus 4*d*. As for the size of the black belt, the black belt is formed so that in terms of the direction parallel to the axial line of the photosensitive drum 1*d*, its dimension matches the entirety of image formation range, and in terms of the circumferential direction of the photosensitive drum 1*d*, its dimension matches, or is greater than, the circumference of the secondary transfer roller 14. In other words, the black belt is given such a size that no matter where on the surface of the intermediary transfer belt 7 the black belt will be placed, and no matter which portion of the peripheral surface of the secondary transfer roller, in terms of the circumferential direction of the roller 14, will be kept in contact the intermediary transfer belt 7 (no matter where on the peripheral surface of the secondary transfer roller 14, in terms of the circumferential direction of the roller 14, the additives will be adhere), the portion of the peripheral surface of the secondary transfer roller 14, to which the additives will have adhered, will be covered with the black belt.

Figure 11:
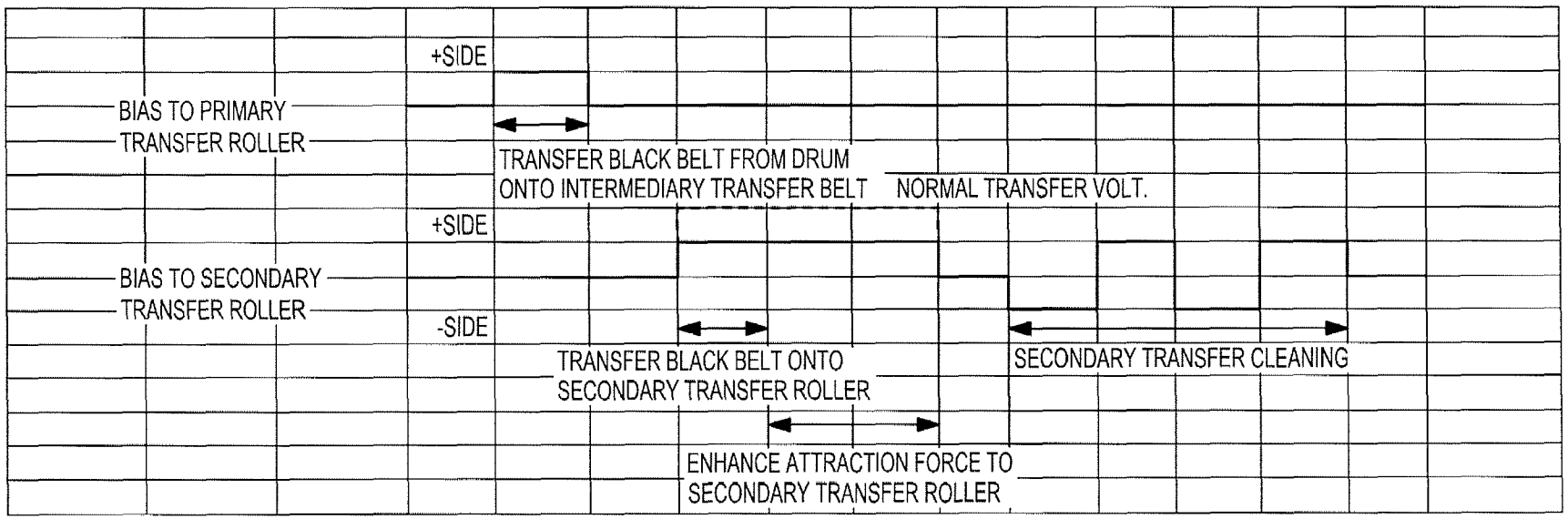
FIG. 11 is a timing chart describing the timing with which biases are applied to the first and second transfer rollers, in the mode in which the secondary transfer roller is coated with toner, in the third embodiment.
Figure 12:
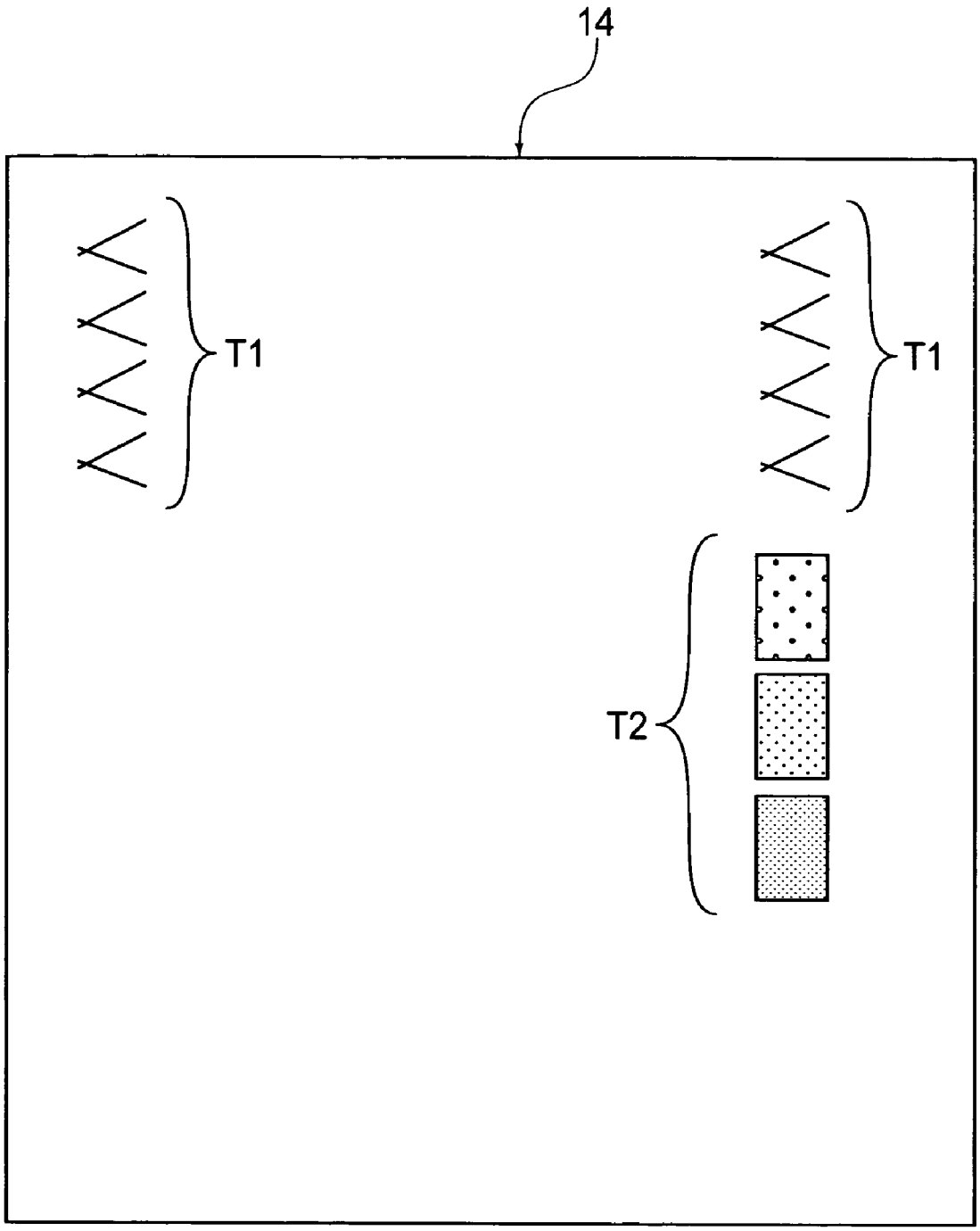
FIG. 12 is a drawing showing the patch detection patterns formed in the adjacencies of the lateral edges of the intermediary transfer belt, and the resist detection patterns.
Figure 13:
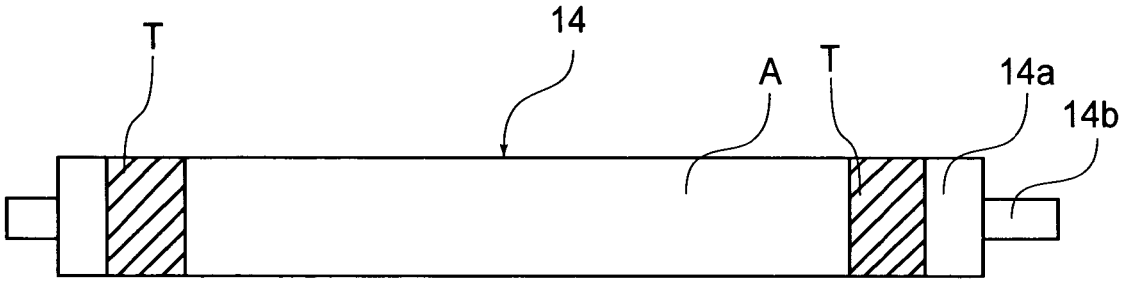
FIG. 13 is a drawing showing the phenomenon that toner adheres to the adjacencies of the lengthwise ends of the secondary transfer roller by a greater amount than to the other areas of the transfer roller.

After the formation of the black belt on the photosensitive drum 1*d*, the black belt is electrostatically transferred (S23 in FIG. 10) onto the intermediary transfer belt 7 by the primary transfer roller 5*d* (FIG. 2). Referring to the top half of FIG. 11, the bias applied to the primary transfer roller 5*d* during this transfer is positive in polarity like the primary transfer bias applied during a normal image forming operation. Next, referring to the bottom half of FIG. 11, the black belt on the intermediary transfer belt 7 is electrostatically transferred onto the secondary transfer roller 14 (S24 in FIG. 10). The bias applied to the secondary transfer roller 14 during this transfer is the same in polarity (positive) as the DC component of the secondary transfer bias (dotted line in FIG. 11) applied during a normal image forming operation, and is smaller in absolute value. The DC component of the secondary transfer bias applied to the secondary transfer roller 14 during a normal image forming operation is +2 Kv, and the bias applied to the secondary transfer roller 14 to transfer the black belt onto the secondary transfer roller 14 is +1.4 Kv. In other words, the absolute value of the DC component of the bias applied to the secondary transfer roller 14 when the secondary transfer roller coating mode is carried out is smaller than the absolute value of the bias applied to the secondary transfer roller 14 during a normal image formation, for the following reason: When transferring the black belt onto the secondary transfer roller 14, there is no recording medium S in the transfer nip N2 between the intermediary transfer belt 7 and the secondary transfer roller 14, unlike in a normal image formation. Therefore, the black belt can be satisfactorily transferred with the application of a bias, the absolute value of which is smaller than that of the bias applied for a normal image transfer operation. That is, the normal transfer bias is set so that a proper amount of transfer current flows with the presence of the recording medium S in the transfer nip N2, and therefore, when the recording medium S is not present in the transfer nip N2 as it is not in this secondary transfer roller coating mode, it is prudent to reduce the second transfer bias. Further, the value of the electrical resistance of the ion-conductive transfer roller is likely to be affected by the ambient temperature and humidity. Therefore, it is desired that the voltage is set according to the ambient temperature and humidity. Also in this embodiment, in order to improve in fastness the adhesion between the black belt and the secondary transfer roller 14, the bias is continuously applied for a length of time equivalent to two full rotations of the secondary transfer roller 14 after the transfer of the black belt onto the secondary transfer roller 14 (S25 in FIG. 10; period correspondent to improvement in adhesion between toner and secondary transfer roller in FIG. 11).

It should be noted here that in this embodiment, applying a transfer bias opposite in polarity as the transfer bias applied to the secondary transfer roller 14 during a normal image formation, to the secondary transfer roller 14 for a length of time necessary to give the secondary transfer roller 14 one full turn, and then, applying a transfer bias the same in polarity as the bias applied to the secondary transfer roller 14 during a normal image forming operation for a length of time necessary to give the secondary transfer roller 14 one full turn, is not sufficient for satisfactorily cleaning the secondary transfer roller 14. In other words, applying two biases different in polarity to the secondary transfer roller 14 for a length of time necessary to give the secondary transfer roller 14 two full turns, or one full turn per bias, is not sufficient to satisfactorily clean the secondary transfer roller 14.

In this embodiment, therefore, a process of applying a bias opposite in polarity to the bias applied during a normal image forming operation, for a length of time equal to the length of time necessary to give the secondary transfer roller 14 one full turn, and then, applying a bias the same in polarity to the bias applied during a normal image forming operation, for a length of time equal to the length of time necessary to give the secondary transfer roller 14 one full turn, is repeated twice. In other words, referring to FIG. 11, the secondary transfer roller 14 is rotated one full turn while applying the bias opposite (negative) in polarity to the bias applied to the secondary transfer roller 14 during a normal image forming operation, and then, it is rotated another full turn while applying the bias (positive) the same in polarity as the bias applied during a normal image forming operation. Then, the secondary transfer roller 14 is again rotated one full turn while applying the bias opposite (negative) in polarity to the bias applied to the secondary transfer roller 14 during a normal image forming operation, and then, it is rotated another full turn while applying the bias (positive) the same in polarity as the bias applied during a normal image forming operation (S26 in FIG. 10). This procedure is satisfactory to satisfactorily remove the excess amount of toner on the secondary transfer roller 14, making it possible to prevent the occurrence of the contamination of the backside of a recording medium S, at a higher level of success, during the following image forming operation. The biases applied to the secondary transfer roller 14 during this operation are DC voltages; the bias opposite in polarity to the bias applied during a normal image forming operation is −700 V, and bias the same in polarity to the bias applied during a normal image forming operation is +1.4 Kv. This ends the mode in which the secondary transfer roller 14 is coated with toner (S27). Although in this embodiment described above, the secondary transfer roller 14 was rotated twice per bias while alternately applying the abovementioned two biases to the secondary transfer roller 14, during the cleaning operation. Instead, however, the secondary transfer roller 14 may be rotated no less than three times per bias while alternately applying the abovementioned two biases to the secondary transfer roller 14. Incidentally, shown in FIG. 14 is the cleaning sequence carried out during a normal image forming operation. In the cleaning process carried out in a normal image forming operation, toner is removed from the secondary transfer roller 14 to prevent the formation of foggy images. Therefore, the number of times the bias opposite in polarity to the bias applied to the secondary transfer roller 14 for image transfer, and the bias the same in polarity as the bias applied to the secondary transfer roller 14 for image transfer, need to be alternately applied to the secondary transfer roller 14 to clean the secondary transfer roller 14 is only once.

This embodiment can offer the same effects as the first embodiment. In comparison to the first embodiment, this embodiment makes it possible to reduce the transfer bias applied to transfer a black belt from the intermediary transfer belt 7 onto the secondary transfer roller 14, improve in fastness the adhesion between the black belt and secondary transfer roller 14, and more satisfactorily remove the excessive amount of toner on the secondary transfer roller 14.

In this embodiment described above, the intermediary transfer medium was the intermediary transfer belt 7. However, it is possible to employ an intermediary transfer drum, instead of the intermediary transfer belt 7, as the intermediary transferring member. The effects of the present invention, which will be realized with the employment of an intermediary transfer drum, will be virtually the same as those realized by the above described embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 285228/2004 filed Sep. 29, 2004 which is hereby incorporated by reference.

What is claimed is:

1. An image forming apparatus comprising:

an image bearing member for carrying a toner image;

toner image forming means for forming a toner image on said image bearing member;

a transfer roller for contacting said image bearing member to form a nip therebetween and for being supplied with a voltage to transfer the toner image from said image bearing member onto the recording material in the nip;

a voltage source for applying a voltage to said transfer roller;

executing means for executing a toner application mode for transferring the toner image onto the transfer roller by applying a voltage to said transfer roller contacted to the toner image in the nip, wherein a size of the toner image transferred onto said transfer roller during an operation in the toner application mode is equal to or longer than one full circumferential length of said transfer roller with respect to a peripheral moving direction of said image bearing member and is equal to an image forming area of said image bearing member with respect to a direction perpendicular to the peripheral moving direction of said image bearing member.

2. An apparatus according to claim 1, wherein said transfer roller is made of an ion electroconductive material.

3. An apparatus according to claim 1, wherein the toner image on said image bearing member has an optical density of not less than 0.6.

4. An apparatus according to claim 1, wherein the toner application mode operation includes a cleaning step of transferring, onto said image bearing member, toner which has been transferred as the toner image and which is deposited on said transfer roller.

5. An apparatus according to claim 1, wherein the toner image on said image bearing member has an optical density of not less than 0.6.

6. An apparatus according to claim 1, wherein the toner image on said image bearing member has an optical density of not less than 0.6.

7. An apparatus according to claim 1, wherein in the operation in the toner application mode, a voltage of a polarity which is opposite that of the voltage applied to said transfer roller to transfer the toner image from said image bearing member onto the recording material is applied to said transfer roller to transfer the toner deposited on said transfer roller onto said image bearing member.

* * * * *

UNITED STATES PATENT AND TRADEMARK OFFICE

CERTIFICATE OF CORRECTION

PATENT NO. : 7,398,043 B2
APPLICATION NO. : 11/234234
DATED : July 8, 2008
INVENTOR(S) : Yuichi Ikeda et al.

It is certified that error appears in the above-identified patent and that said Letters Patent is hereby corrected as shown below:

On the cover page, item should read

[*] Notice: Subject to any disclaimer, the term of this patent is extended or adjusted under 35 U.S.C. 154(b) by (228) days Signed and Sealed this Twenty-eighth Day of April, 2009

John Doll

JOHN DOLL
*Acting Director of the United States Patent and Trademark Office*